US010788003B2

(12) United States Patent
Hashida et al.

(10) Patent No.: US 10,788,003 B2
(45) Date of Patent: Sep. 29, 2020

(54) HIGH-PRESSURE FUEL SUPPLY PUMP

(71) Applicant: Hitachi Automotive Systems, Ltd., Hitachinaka-shi, Ibaraki (JP)

(72) Inventors: Minoru Hashida, Hitachinaka (JP); Atsushi Hohkita, Hitachinaka (JP); Masayuki Suganami, Hitachinaka (JP); Satoshi Usui, Hitachinaka (JP); Masaru Kawai, Hitachinaka (JP); Arata Kagiyama, Hitachinaka (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 0 days.

(21) Appl. No.: 16/091,160

(22) PCT Filed: Mar. 10, 2017

(86) PCT No.: PCT/JP2017/009646
§ 371 (c)(1),
(2) Date: Oct. 4, 2018

(87) PCT Pub. No.: WO2017/175539
PCT Pub. Date: Oct. 12, 2017

(65) Prior Publication Data

US 2019/0128229 A1 May 2, 2019

(30) Foreign Application Priority Data

Apr. 6, 2016 (JP) ..... 2016-076268

(51) Int. Cl.
*F02M 61/16* (2006.01)
*F02M 59/36* (2006.01)
(Continued)

(52) U.S. Cl.
CPC ..... *F02M 59/36* (2013.01); *F02D 41/3836* (2013.01); *F02M 57/027* (2013.01);
(Continued)

(58) Field of Classification Search
CPC ..... B32B 2307/554; F02M 61/166; F02M 2200/9038
See application file for complete search history.

(56) References Cited

U.S. PATENT DOCUMENTS 6,254,364 B1 * 7/2001 Onishi ..... F04B 11/0016 138/26
9,677,021 B2 * 6/2017 Iwata ..... F16O 33/145
(Continued)

FOREIGN PATENT DOCUMENTS

CN 1940287 A 4/2007
EP 1 249 513 A1 10/2002
(Continued)

OTHER PUBLICATIONS

Japanese-language Office Action issued in counterpart Japanese Application No. 2018-510281 dated Jun. 11, 2019 with English translation (10 pages).
(Continued)

*Primary Examiner* — Long T Tran
(74) *Attorney, Agent, or Firm* — Crowell & Moring LLP

(57) ABSTRACT

It is an object of the present invention to provide a high-pressure fuel supply pump having a pump body capable of improving corrosion resistance and weldability and being manufacturable by forging. Therefore, in the high-pressure fuel supply pump having a metal pump body forming a pressurizing chamber, the pump body is made of a steel material containing 12% to 18% of Cr and 3% to 7% of Ni, and the pump body has a forging surface on a part of the outer peripheral surface.

18 Claims, 9 Drawing Sheets

(51) Int. Cl.

| | |
|---|---|
| ***F02M 59/46*** | (2006.01) |
| ***F02M 59/48*** | (2006.01) |
| ***F02M 59/44*** | (2006.01) |
| ***F02D 41/38*** | (2006.01) |
| ***F02M 57/02*** | (2006.01) |
| *C21D 9/00* | (2006.01) |
| *F02M 63/02* | (2006.01) |

(52) U.S. Cl.
CPC ..... *F02M 59/44* (2013.01); *F02M 59/445* (2013.01); *F02M 59/46* (2013.01); *F02M 59/48* (2013.01); *C21D 9/0068* (2013.01); *F02M 63/0225* (2013.01); *F02M 2200/8046* (2013.01); *F02M 2200/8084* (2013.01)

(56) References Cited

U.S. PATENT DOCUMENTS

| | | | | |
|---|---|---|---|---|
| 2003/0102058 | A1 | 6/2003 | Ishikawa et al. | |
| 2005/0084388 | A1* | 4/2005 | Hayes | F04B 1/141 417/222.1 |
| 2007/0020131 | A1 | 1/2007 | Schroeder et al. | |
| 2007/0071614 | A1* | 3/2007 | Inoue | F04B 53/162 417/297 |
| 2013/0336826 | A1* | 12/2013 | Kim | F04B 43/02 417/474 |
| 2016/0333932 | A1* | 11/2016 | Iwata | B32B 27/32 |
| 2017/0037822 | A1 | 2/2017 | Yagai et al. | |

FOREIGN PATENT DOCUMENTS

| | | | |
|---|---|---|---|
| EP | 2 759 694 | A1 | 7/2014 |
| JP | 11-209854 | A | 8/1999 |
| JP | 2000-265211 | A | 9/2000 |
| JP | 2002-371339 | A | 12/2002 |
| JP | 2005-105902 | A | 4/2005 |
| JP | 2006-214301 | A | 8/2006 |
| JP | 2007-120492 | A | 5/2007 |
| JP | 2008-111396 | A | 5/2008 |
| JP | 2010-270366 | A | 12/2010 |
| JP | 2012-251467 | A | 12/2012 |
| WO | WO 2014/083979 | A1 | 6/2014 |
| WO | WO 2015/110622 | A1 | 7/2015 |
| WO | WO 2015/163245 | A1 | 10/2015 |

OTHER PUBLICATIONS

International Search Report (PCT/ISA/210) issued in PCT Application No. PCT/JP2017/009646 dated Jun. 20, 2017 with English translation (four (4) pages).
Japanese-language Written Opinion (PCT/ISA/237) issued in PCT Application No. PCT/JP2017/009646 dated Jun. 20, 2017 (five (5) pages).
Partial Supplementary European Search Report issued in counterpart European Application No. 17778918.7 dated Oct. 9, 2019 (12 pages).
Japanese-language Office Action issued in counterpart Japanese Application No. 2018-510281 dated Nov. 5, 2019 with English translation (10 pages).
Extended European Search Report issued in European Application No. 17778918.7 dated Feb. 18, 2020 (11 pages).

* cited by examiner

HIGH-PRESSURE FUEL SUPPLY PUMP

TECHNICAL FIELD

The present invention relates to a high-pressure fuel supply pump for pumping fuel to a fuel injection valve of an internal combustion engine, and in particular, to a structure that a pump body provided with a pressurizing chamber for pressurizing a fuel is provided, and functional parts such as an electromagnetic suction valve mechanism are attached to the pump body.

BACKGROUND ART

PTL 1 discloses a conventional technique of the high-pressure fuel pump of the present invention. PTL 1 describes that "the pump housing is integrally molded by casting iron material such as low carbon steel, austenitic stainless steel, or ferritic stainless steel" (refer to paragraph 0049).

CITATION LIST

Patent Literature

PTL 1: JP 2007-120492 A

SUMMARY OF INVENTION

Technical Problem

According to FIG. 1 of the above-described patent literature, as described in paragraph 0018, "a pump housing 40 includes a cylinder 42, a tappet guide 44, a flange 46, a solenoid valve support portion 48, a suction portion 50, and a discharge portion 70, and the pump housing is integrally molded by casting of an iron material such as stainless steel and then hardened by quenching". However, since the material curable by quenching is inferior in corrosion resistance, it is necessary to perform a surface treatment such as plating on the outer peripheral side of the body, which may result in an increase in the production cost. In addition, when other functional parts such as an electromagnetic suction valve mechanism are welded and joined to the pump body, the material hardened by quenching has low weldability, and cracking may occur at the time of welding.

As a countermeasure to this weldability, it is considered that a flange and a pump body are integrally formed by casting a pump body, and as the material, a low carbon steel not quenched, in particular, an austenitic stainless steel, a ferritic stainless steel, or the like is used. However, when these low carbon steels or ferritic stainless steels are used as a countermeasure against weldability, the corrosion resistance is also inferior. Therefore, it is necessary to perform plating to the outer peripheral side of the pump body, which may result in an increase in the production cost. In the case of austenitic stainless steel, there is no need to perform plating, but the strength of the pump body operating at high pressure is insufficient, and the difference in thermal expansion is different from that of the high hardness parts used inside the pump. Therefore, there is a possibility that gaps are formed in the checking and verifying portion and the fastening portion between the high hardness parts and the pump body at high temperature or low temperature such that necessary performance as a pump cannot be exhibited.

Accordingly, it is an object of the present invention to provide a high-pressure fuel supply pump provided with a pump body capable of improving corrosion resistance and weldability and being manufacturable by forging.

Solution to Problem

To achieve the above object, the present invention is characterized in that "in a high-pressure fuel supply pump provided with a metallic pump body forming a pressurizing chamber, the pump body is made of a steel material containing 12% to 18% of Cr and 3% to 7% of Ni, and the pump body has a forging surface on a part of the outer peripheral surface".

Advantageous Effects of Invention

According to the present invention, it is possible to provide a high-pressure fuel supply pump having a pump body which can be manufactured by forging while improving corrosion resistance and weldability. Other constitutions, actions, and effects of the present invention will be described in detail in the following embodiments.

DESCRIPTION OF EMBODIMENTS

Embodiments of the present invention will be described below with reference to the drawings.

First Embodiment

First, a first embodiment of the present invention will be described in detail with reference to the drawings.

Figure 7:
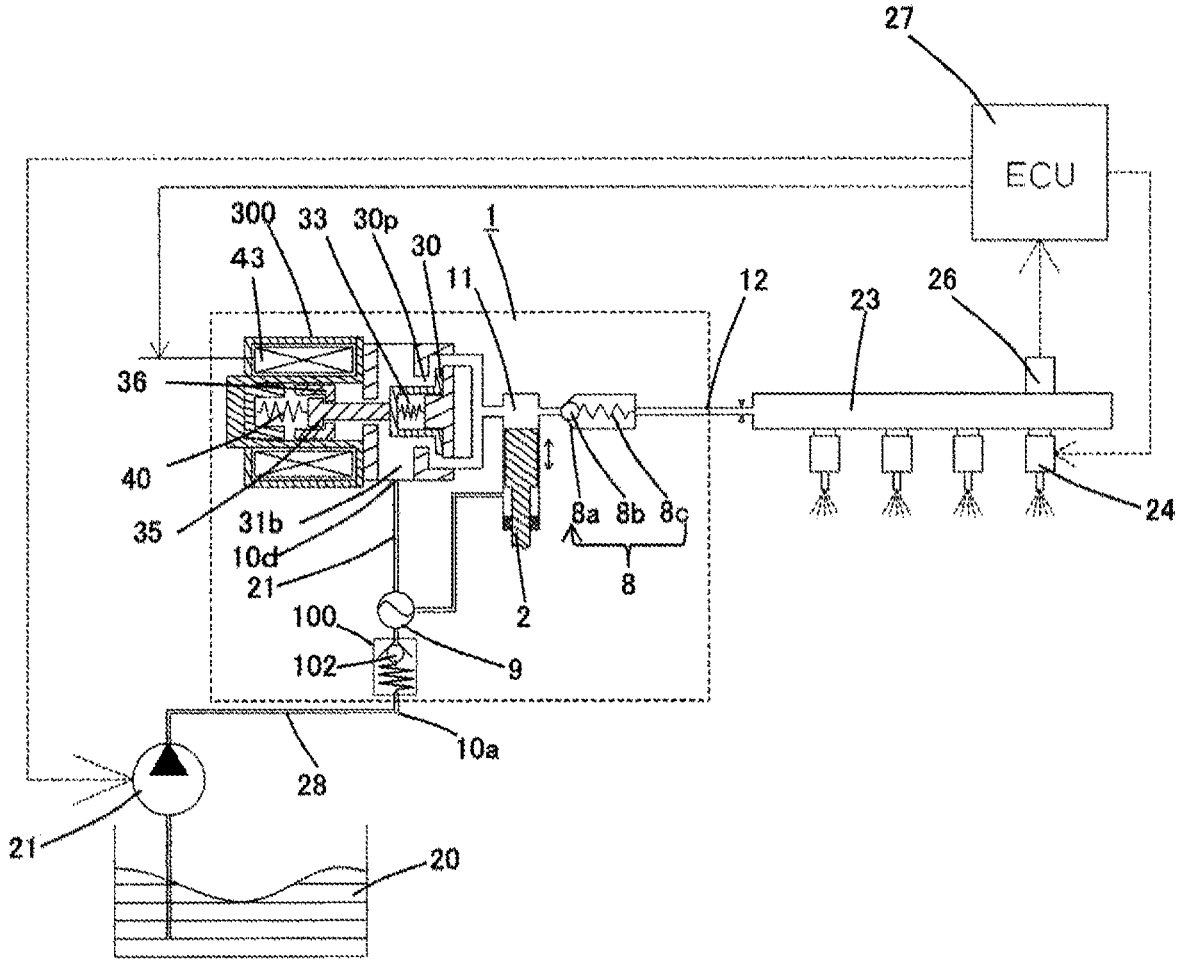
FIG. 7 is a configuration diagram of an engine system to which the high-pressure fuel supply pump according to the first embodiment of the present invention is applied.

With reference to the overall configuration diagram of the engine system of FIG. 7, the configuration and operation of the system will be described. The part surrounded by the broken line shows the main body of the high-pressure fuel supply pump (hereinafter referred to as a high-pressure pump), and the mechanism/parts in this broken line indicate that those are integrally incorporated in a pump body 1.

Fuel in a fuel tank 20 is pumped up by a feed pump 21 based on a signal from an engine control unit 27 (hereinafter referred to as an ECU). This fuel is pressurized to an appropriate feed pressure and sent to a low pressure fuel suction port 10*a* of the high pressure pump through a suction pipe 28. Fuel that has passed through a suction joint 51 from the low-pressure fuel suction port 10*a* reaches a suction port 31*b* of an electromagnetic suction valve 300 included in a capacity variable mechanism via a pressure pulsation propagation preventing mechanism 100 having a valve 102, a pressure pulsation reduction mechanism 9, and a suction passage.

The fuel flowing into the electromagnetic suction valve 300 passes through a fuel introduction passage 30*p* and a valve body 30 and flows into the pressurizing chamber 11. Power to reciprocate a plunger 2 is given by a cam mechanism 93 of an engine. Due to the reciprocating motion of the plunger 2, fuel is sucked from the valve body 30 in the descending stroke of the plunger 2, and the fuel is pressurized in the rising stroke. Fuel is pumped through a discharge valve mechanism 8 to a common rail 23 on which a pressure sensor 26 is mounted. Based on the signal from the ECU 27, an injector 24 injects fuel to the engine. The present embodiment is a high pressure pump applied to a so-called direct injection engine system in which the injector 24 blows fuel directly into a cylinder of the engine.

The high pressure pump discharges fuel by a signal from the ECU 27 to the electromagnetic suction valve 300 such that the fuel flow is at a desired supply rate.

Figure 1:
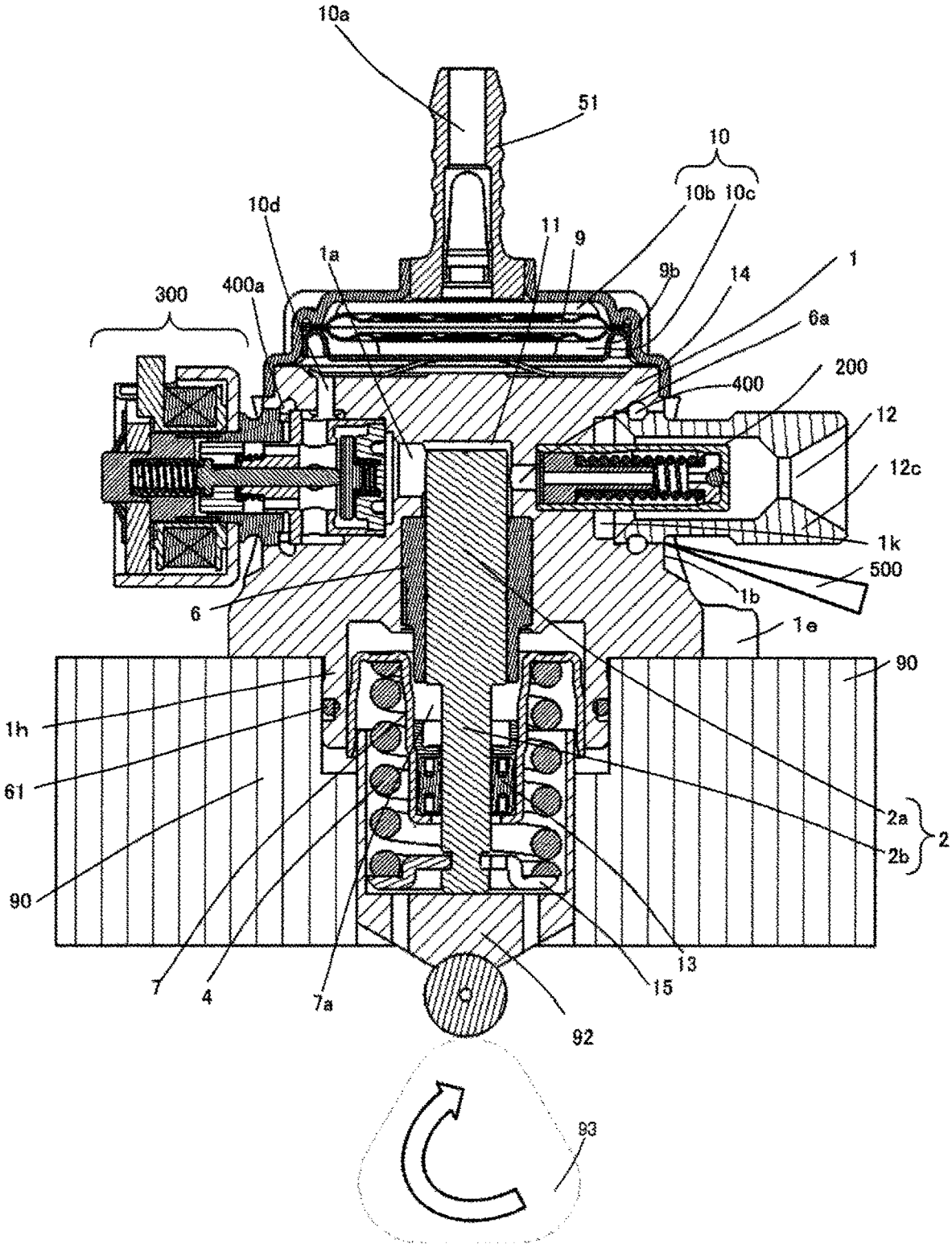
FIG. 1 is a longitudinal sectional view of a high-pressure fuel supply pump according to a first embodiment of the present invention.
Figure 2:
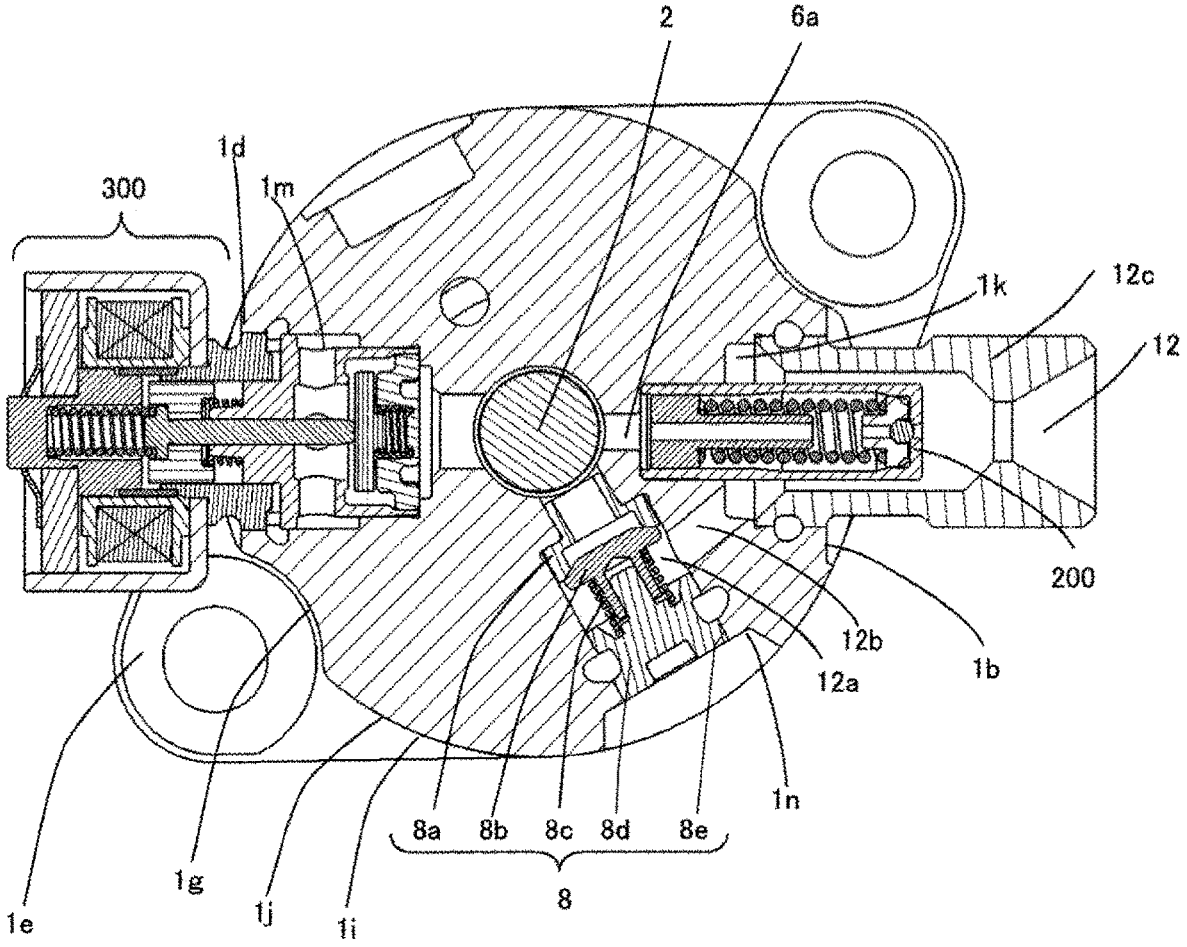
FIG. 2 is a horizontal sectional view of the high-pressure fuel supply pump according to the first embodiment of the present invention as viewed from above.
Figure 3:
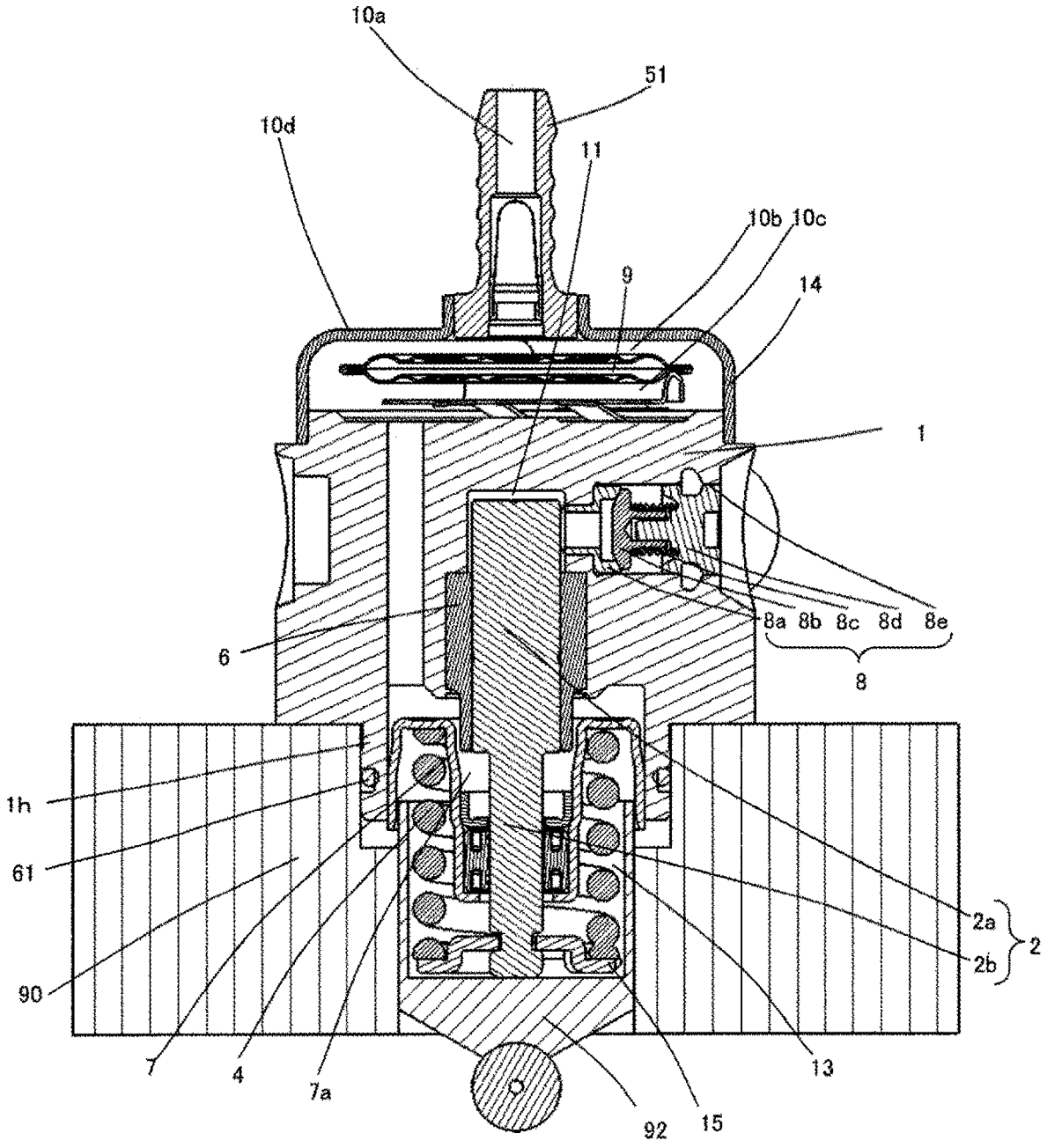
FIG. 3 is a longitudinal sectional view of the high-pressure fuel supply pump according to the first embodiment of the present invention as viewed from a different direction from FIG. 1.
Figure 4:
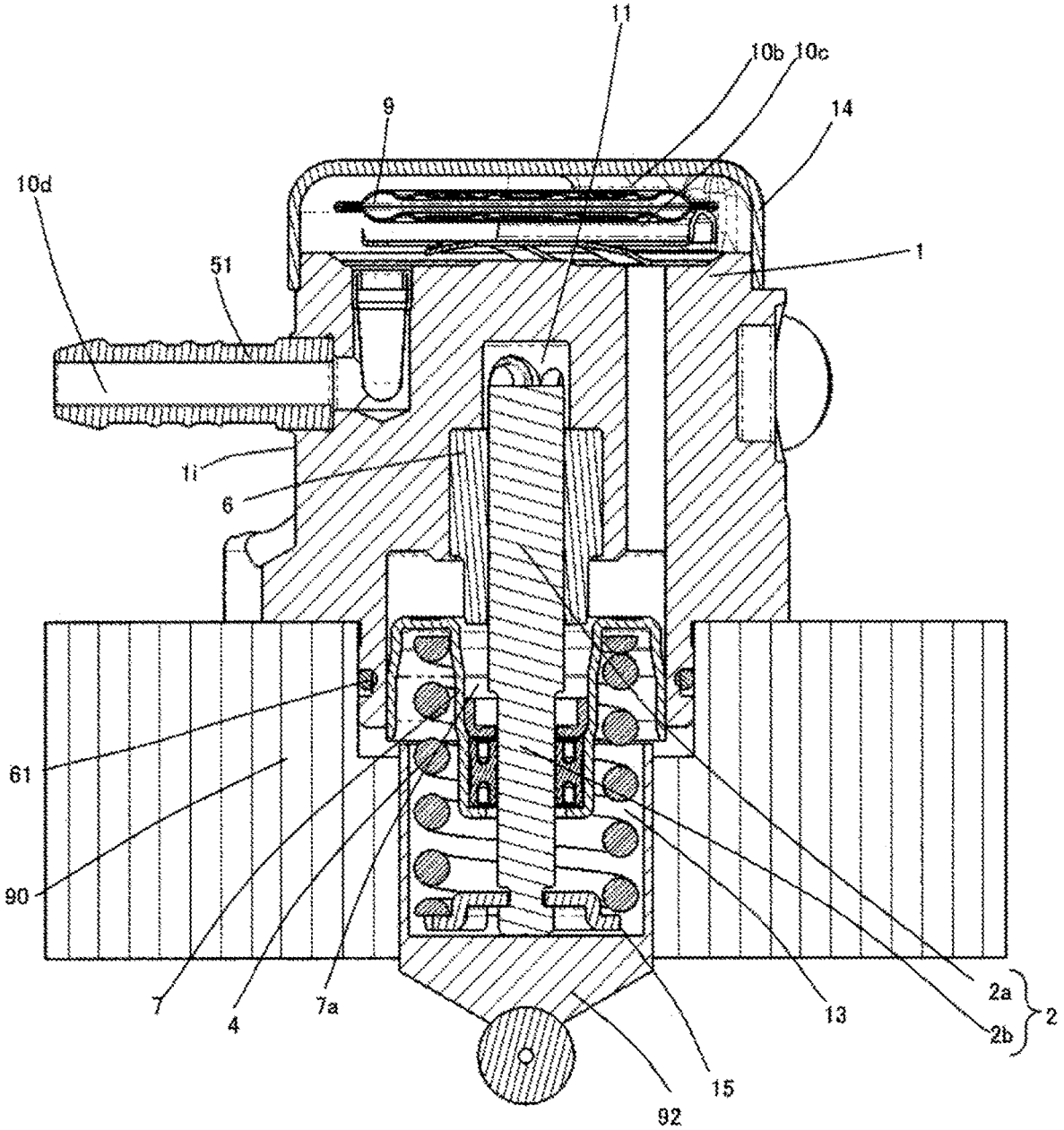
FIG. 4 is a longitudinal sectional view of a high-pressure fuel supply pump in which a suction joint according to the first embodiment of the present invention is attached to a side surface of a pump body.
Figure 5:
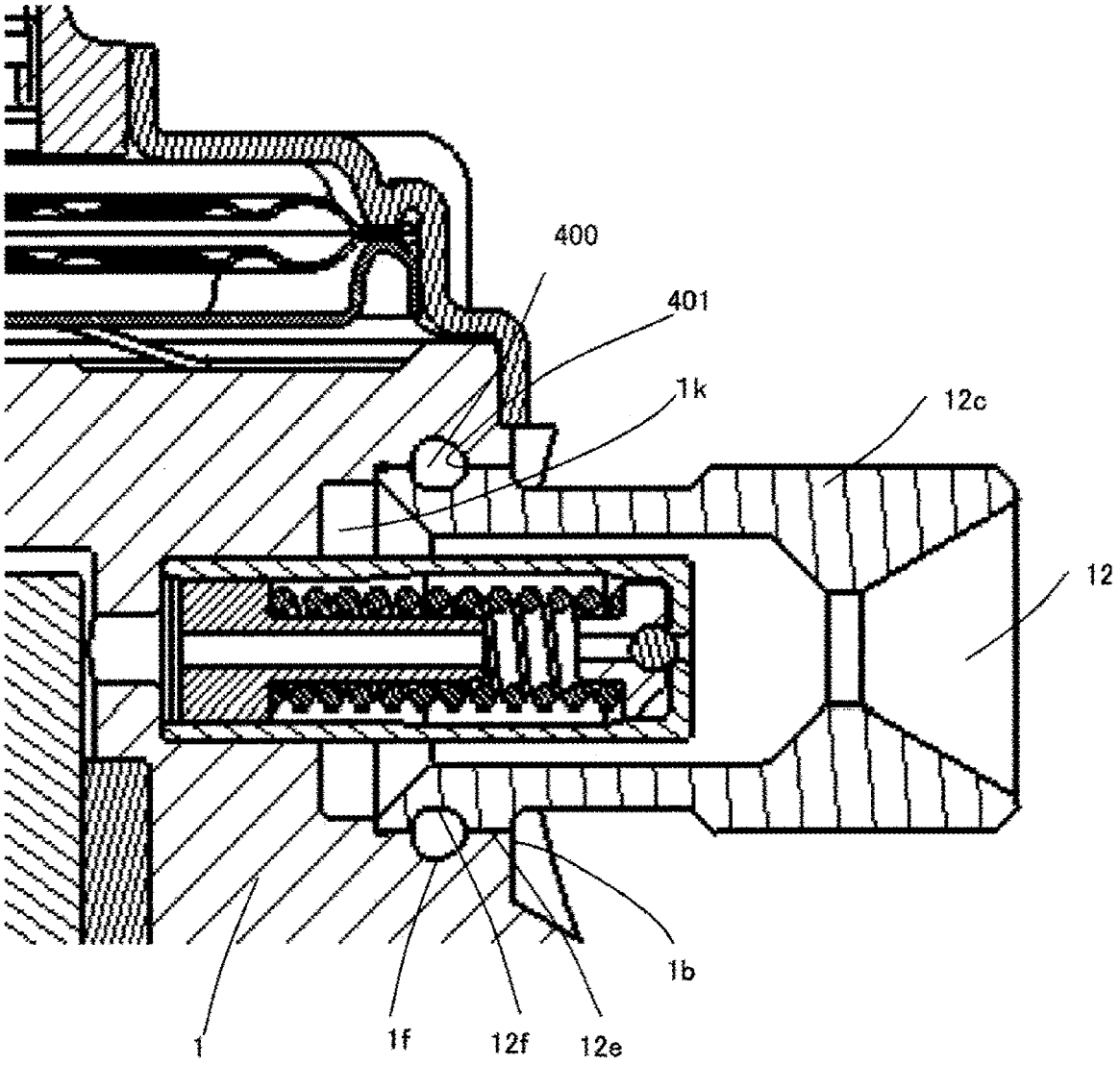
FIG. 5 illustrates a welding structure of a discharge joint of the high-pressure fuel supply pump according to the first embodiment of the present invention.

FIG. 1 is a longitudinal sectional view of a high-pressure pump according to the present embodiment. FIG. 2 is a horizontal cross-sectional view of the high-pressure pump as viewed from above. Further, FIG. 3 is a longitudinal sectional view of the high-pressure pump as viewed from a different direction from FIG. 1. In FIG. 1, the suction joint 51 is provided on the upper portion of a damper cover, whereas FIG. 4 is a longitudinal sectional view of the high-pressure pump in which the suction joint 51 is provided on the side surface of the pump body 1.

First, the present embodiment will be described with reference to FIG. 1. The high-pressure pump of the present embodiment is attached to a flat surface of a cylinder head 90 of an internal combustion engine by using a mounting flange 1*e* provided on the pump body 1 and is fixed by a plurality of bolts (not illustrated).

To seal between the cylinder head 90 and the pump body 1, an O-ring 61 is fitted into the pump body 1 to prevent an engine oil from leaking to the outside.

A cylinder for guiding reciprocating motion of the plunger 2 is attached to the pump body 1. The electromagnetic suction valve 300 for supplying fuel to the pressurizing chamber 11, and the discharge valve mechanism 8 for discharging fuel from the pressurizing chamber 11 to a discharge passage to prevent reverse flow are provided. The fuel having passed through the discharge valve mechanism 8 is connected to engine side parts by a discharge joint 12*c*.

The cylinder 6 is fixed to the pump body 1 by press fitting on its outer peripheral side. The cylinder is sealed such that the fuel pressurized from a gap between a surface of the cylindrical press-fit portion and the pump body 1 does not leak to the low pressure side. By bringing the cylinder into contact with the flat surface in the axial direction, the cylinder is doubled sealed, in addition to sealing the cylindrical press-fit portion between the pump body 1 and the cylinder 6.

At the lower end of the plunger 2, a tappet 92 is provided for converting rotational motion of a cam 93 attached to a camshaft of the internal combustion engine into up-and-down motion and transmitting the motion to the plunger 2. The plunger 2 is crimped to the tappet 92 by a spring 4 via a retainer 15. As a result, the plunger 2 can reciprocate up and down along with the rotational motion of the cam 93.

The plunger seal 13 held at the lower end portion of the inner periphery of the seal holder 7 is disposed in slidable contact with the outer periphery of the plunger 2 at the lower portion of the cylinder 6 in the drawing. Thereby, when the plunger 2 slides, the fuel in an auxiliary chamber 7*a* is sealed and prevented from flowing into the internal combustion engine. At the same time, it prevents a lubricant (including engine oil) lubricating the sliding portion in the internal combustion engine from flowing into the pump body 1.

A suction joint 51 is attached to the pump body 1 or a damper cover 14. The suction joint 51 is connected to a low pressure pipe that supplies fuel from the fuel tank 20 of a vehicle, and the fuel is supplied to the inside of the high pressure pump from the low pressure pipe. A suction filter 52 in the suction joint 51 serves to prevent foreign matter present between the fuel tank 20 and the low pressure fuel suction port 10*a* from being absorbed into the high-pressure fuel supply pump by the flow of fuel.

The fuel having passed through the low pressure fuel suction port 10*a* reaches the suction port 31*b* of the electromagnetic suction valve 300 via a pressure pulsation reduction mechanism 9 and a low pressure fuel flow path 10*d*.

The discharge valve mechanism 8 provided at the outlet of the pressurizing chamber 11 includes a discharge valve seat 8*a*, a discharge valve 8*b*, a discharge valve spring 8*c*, and a stopper 8*d*. The discharge valve 8*b* moves toward and away from the discharge valve seat 8*a*. The discharge valve spring 8*c* energizes the discharge valve 8*b* toward the discharge valve seat 8*a*. The stopper 8*d* determines a stroke (moving distance) of the discharge valve 8*b*. The discharge valve stopper 8*d* and the pump body 1 are joined at a contact portion 8*e* by welding to shut off a fuel from the outside.

When there is no fuel pressure difference between the pressurizing chamber 11 and the discharge valve chamber 12*a*, the discharge valve 8*b* is crimped to the discharge valve seat 8*a* by energizing force of the discharge valve spring 8*c* and is in a closed state. The discharge valve 8*b* opens against the discharge valve spring 8*c* only when the fuel pressure in the pressurizing chamber 11 becomes larger than the fuel pressure in the discharge valve chamber 12*a*. The high-pressure fuel in the pressurizing chamber 11 is discharged to the common rail 23 via the discharge valve chamber 12*a*, the fuel discharge passage 12*b*, and the fuel discharge port 12 covered by the discharge valve cover 12*d*. When the discharge valve 8*b* opens, it comes into contact with the discharge valve stopper 8*d*, and the stroke is limited. Therefore, the stroke of the discharge valve 8*b* is appropriately determined by the discharge valve stopper 8*d*. As a result, the stroke is so large that the fuel discharged to the discharge valve chamber 12*a* at a high pressure can be prevented from flowing back into the pressurizing chamber 11 again due to closing delay of the discharge valve 8*b*, and consequently the efficiency reduction of the high-pressure pump can be suppressed. When the discharge valve 8*b* repeats valve opening and closing movements, the discharge valve 8*b* guides on the outer peripheral surface of the discharge valve stopper 8*d* so as to move only in the stroke direction. With the above configuration, the discharge valve mechanism 8 becomes a check valve that restricts the flowing direction of the fuel.

As described above, the pressurizing chamber 11 includes the pump body 1, the electromagnetic suction valve 300, the plunger 2, the cylinder 6, and the discharge valve mechanism 8.

When the plunger 2 moves in the direction of the cam 93 by the rotation of the cam 93 and is in a suction stroke state, the volume of the pressurizing chamber 11 increases, and the fuel pressure in the pressurizing chamber 11 decreases. When the fuel pressure in the pressurizing chamber 11 becomes lower than the pressure of the suction passage 10*d* in this process, the valve body 30 is in an open state. Therefore, the fuel passes through the opening formed by opening the valve body 30, passes through a communication hole 1*a* provided in the pump body 1, a groove 6*a* of the cylinder 6, and a communication hole 6*b* and flows into the pressurizing chamber 11.

After the plunger 2 finishes the suction stroke, the plunger 2 turns into an upward movement to shift to a compression stroke. Here, the electromagnetic coil 43 is maintained in a non-energized state, and the magnetic biasing force does not act. The rod biasing spring 40 is set so as to have an energizing force necessary and sufficient for keeping the valve body 30 open in the non-energized state. In the present embodiment, a so-called normally open type high pressure pump is indicated, but the present invention is not limited thereto and is also applicable to a normally closed type high pressure pump. The volume of the pressurizing chamber 11 decreases with compression movement of the plunger 2, but in this state, once the fuel drawn into the pressurizing chamber 11 is returned to the suction passage 10*d* again through the opening of the valve body 30 in a valve opening state such that the pressure in the pressurizing chamber never rises. This process is referred to as returning stroke.

Hereinafter, the electromagnetic suction valve 300 will be described with reference to FIG. 6. The electromagnetic suction valve 300 is a mechanism for sucking fuel and supplying the fuel to the pressurizing chamber 11 by moving a magnetic core 39, a movable core 36, a rod 35, and the valve body 30 disposed following them by energization to the magnetic coil 43. These functions will be described in detail below.

As described above, in the non-energized state, the valve body 30 is a normally open type to operate in the valve opening direction by the strong rod biasing spring 40. However, when a control signal from the engine control unit 27 (hereinafter referred to as ECU) is applied to the electromagnetic suction valve 300, a current flows through the terminal 46 to the electromagnetic coil 43. When the current flows, the magnetic core 39 generates a magnetic attraction force.

Figure 6:
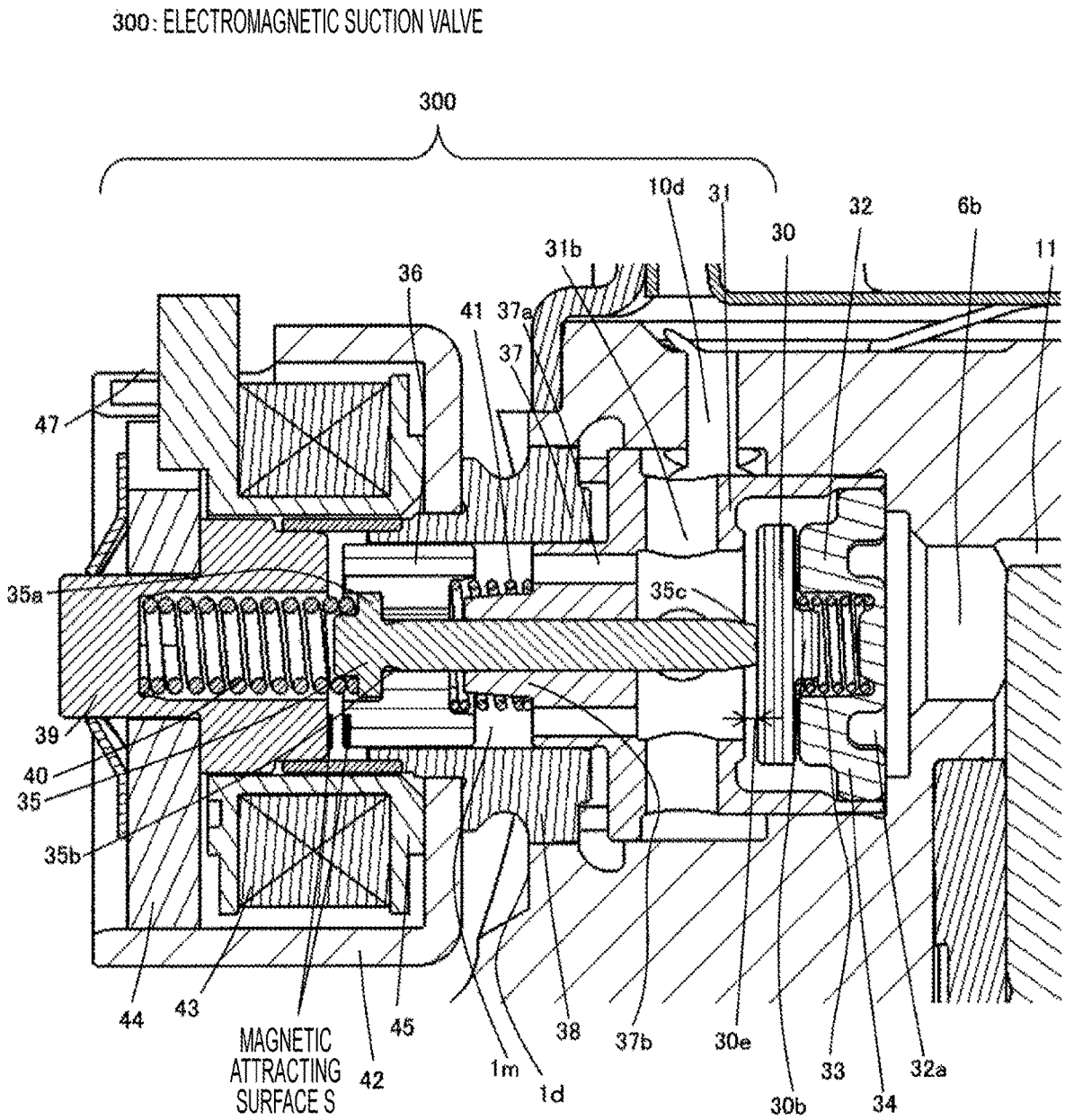
FIG. 6 is an enlarged vertical sectional view of an electromagnetic suction valve mechanism of the high-pressure fuel supply pump according to the first embodiment of the present invention and illustrates an open valve state of the electromagnetic suction valve.

Accordingly, the movable core 36 is attracted in the valve closing direction by the magnetic attraction force of the magnetic core 39 on a magnetic attracting surface S also illustrated in FIG. 6. A rod 35 having a flange portion 35*a* for locking the movable core 36 is disposed between the movable cores 36. The rod biasing spring 40 is covered with the lid holding member 39 and the lid member 44. Since the rod 35 has the flange portion 35*a*, the movable core 36 can be locked, such that it can move together with the movable core 36. Therefore, the rod 35 disposed between the movable cores 36 can move in the valve closing direction when the magnetic attracting force is applied. Further, the rod 35 is disposed between the valve closing biasing spring 41 and the rod guide portion 37*b* having the fuel passage 37 in the lower part of the movable core.

The rod 35 has a recessed portion 35*b* recessed toward the inner periphery at a position coming into contact with the movable core 36 in the inner peripheral portion of the flange portion 35*a*. As a result, a relief portion can be formed for bringing the movable core 36 into contact with the position such that breakage of the rod 35 or the movable core 36 due to collision can be prevented. Further, at the tip portion of the rod 35 on the side of the valve body 30, an inclined portion 35*c* having a smaller diameter toward the tip is formed. As a result, even when the core is slightly misaligned when the movable core 36 is inserted into the rod 35, the movable core 36 can be easily incorporated, and the production efficiency can be improved. Since the rod 35 is formed by lathe machining, a recessed portion that is recessed on the side opposite to the valve body 30 is formed at the tip end portion on the side of the valve body 30.

On the lower portion (the suction valve side) of the rod 35, a valve body 30, a suction valve biasing spring 33, and a stopper 32 are provided. The valve body 30 protrudes toward the pressurizing chamber side, and a guide portion 30*b* guided by the suction valve biasing spring 33 is formed. As the rod 35 moves, the valve body 30 moves by an amount corresponding to a gap of the valve body stroke 30*e*, such that the fuel supplied from the supply passage 10*d* in the valve opening state is supplied to the pressurizing chamber. The guide portion 30*b* is press-fitted into the housing of the suction valve mechanism and stops its movement by colliding with the fixed stopper 32. It should be noted that the rod 35 and the valve body 30 are separate and independent structures.

The valve body 30 comes into contact with the valve seat of the valve seat member 31 disposed on the suction side to close the flow path to the pressurizing chamber 11 and separates from the valve seat to open the flow path to the pressurizing chamber 11. Here, the high pressure fuel pump of recent years is required to further increase the pressure, for example, the discharge fuel becomes 30 MPa or more. Therefore, the pressurizing chamber 11 becomes high pressure, and the impact when the valve body 30 collides with the valve seat member 31 or the impact when the valve body 30 collides with the stopper 32 is very large, and it is necessary to increase the strength of the impact.

In the present embodiment, the valve body 30 is arranged in a flat plate shape and is configured to include a flat plate portion and a guide portion 30*b* projecting toward the pressurizing chamber side on the flat plate portion. Here, attention is paid to the thickness of the flat plate portion in the present embodiment as an element which affects the strength. That is, as illustrated in FIG. 6, by increasing the thickness of the flat plate portion of the valve body 30 in the moving direction of the suction valve biasing spring 33, the strength is improved. Specifically, the thickness of the flat plate portion is increased with respect to the thickness of the guide portion 30*b* protruding from the flat plate portion. Further, FIG. 6 is a cross-sectional view of the position where the suction port 31*b* (flow path) formed in the valve seat member 31 is the largest. At this time, it is preferable to make the thickness of the flat plate portion of the valve body 30 thicker than the thickness in the movement direction of the vale seat portion in contact with the flat plate portion of the valve seat member 31 in the downstream side with respect to the suction port 31*b*. With such a configuration, it is possible to provide the strength of the valve body 30.

In summary, the magnetic urging force overcomes the urging force of the rod biasing spring 40, and the rod 35 moves in a direction away from the suction valve 30. Therefore, the suction valve 30 is closed by the urging force of the suction valve biasing spring 33 and the fluid force caused by the fuel flowing into the suction passage 10*d*. After valve closing, the fuel pressure in the pressurizing chamber 11 rises together with the ascending motion of the plunger 2, and when the pressure becomes equal to or higher than the pressure of the fuel discharge port 12, the high-pressure fuel is discharged via the discharge valve mechanism 8, and the high pressure fuel is discharged to the common rail 23. This stroke is referred to as a discharge stroke.

That is, the compression stroke (the upward stroke between the lower starting point and the upper starting point) of the plunger 2 includes a return stroke and a discharge stroke. By controlling the energization timing of the electromagnetic suction valve 300 to the coil 43, the amount of the high-pressure fuel to be discharged can be controlled. If the electromagnetic coil 43 is energized earlier, the rate of the return stroke during the compression stroke is small, and the rate of the discharge stroke is large. That is, the amount of fuel returned to the suction passage 10*d* is small, and the amount of fuel discharged at a high pressure is increased. On the other hand, if the energization timing is delayed, the rate of the return stroke during the compression stroke is large, and the rate of the discharge stroke is small. That is, the amount of fuel returned to the suction passage 10*d* is large, and the amount of fuel discharged at a high pressure is reduced. The energization timing of the electromagnetic coil 43 is controlled by a command from the ECU 27.

By controlling the conduction timing to the electromagnetic coil 43 as described above, it is possible to control the amount of fuel to be discharged at a high pressure to the amount required by the internal combustion engine. A relief valve 200 includes a relief valve cover 201, a ball valve 202, a relief valve retainer 203, a spring 204, and a spring holder 205. The relief valve 200 is a valve which operates only when abnormally high pressure occurs due to some problem in the common rail 23 or a member following the common rail 23, and it plays the role of opening the valve only when the pressure of the common rail 23 of the member following the common rail 23 rises and returning fuel to the pressurizing chamber. Therefore, the relief valve has a very strong spring 204.

In the low-pressure fuel chamber 10, a pressure pulsation reduction mechanism 9 for reducing ripple of pressure pulsation generated in the high pressure pump to the fuel pipe 28. A damper upper portion 10*b* and a damper lower portion 10*c* are provided above and below the pressure pulsation reduction mechanism 9 at intervals. Once the fuel that has flown into the pressurizing chamber 11 is returned to the suction passage 10*d* through the suction valve body 30 that is in the open valve state for capacity control, the fuel returned to the suction passage 10*d* causes the pressure pulsation in the low-pressure fuel chamber 10. However, the pressure pulsation reduction mechanism 9 provided in the low-pressure fuel chamber 10 is formed by a metal diaphragm damper in which two disk-shaped metal plates in a corrugated form are laminated on the outer periphery thereof, and an inert gas such as argon is injected into the inside. The pressure pulsation is absorbed and reduced by expanding/contracting this metal damper. A mounting bracket for fixing a metal damper to the inner peripheral portion of the pump body 1 is denoted by 9*b* and is disposed on the fuel passage. Therefore, a support portion for supporting the damper is not provided around the entire circumference and is partially provided, and the mounting bracket 9*b* is provided such that fluids can freely move back and forth.

The plunger 2 has a large-diameter portion 2*a* and a small-diameter portion 2*b*, and the volume of the auxiliary chamber 7*a* is increased or decreased by the reciprocating motion of the plunger. The auxiliary chamber 7*a* communicates with the low-pressure fuel chamber 10 through a fuel passage 10*e*. When the plunger 2 descends, a flow of fuel is generated from the auxiliary chamber 7*a* to the low-pressure fuel chamber 10, and when the plunger 2 rises, a flow of fuel is generated from the low-pressure fuel chamber 10 to the auxiliary chamber 7*a*.

As a result, it is possible to reduce the fuel flow to the inside and outside of the pump during the suction or return stroke of the pump, and a function to reduce the pressure pulsation generated inside the high-pressure pump is provided.

The discharge joint 12*c* is inserted or press-fitted into the hole 1*k* provided in the pump body 1, and its joint surface 12*e* is welded. On the pump center side of the joining surface, the stress generated at the welding portion during the operation of a pump by a space 400 provided in a recessed portion if formed in the pump body 1 and a recessed portion 12*f* formed in the discharge joint 12*c*.

In the pump configured as described above, the configuration of the pump body 1 according to the present invention will be described in detail. In the present embodiment, the pump body 1 has a forging surface on a part of its outer peripheral surface. That is, since the pump body 1 is formed by forging, the manufacturing cost can be suppressed. Since it is sometimes necessary to carry out cutting work as required after forming the pump body 1 by forging, at least a forging surface is provided on a part of the outer peripheral surface. The surface roughness of the forging surface becomes rough with respect to the surface subjected to machining by cutting. Here, since the high-pressure pump is to be used in an engine room, it is necessary to configure so as to have corrosion resistance enough to withstand this. In this case, it is conceivable to improve the durability by performing a surface treatment such as plating on the outer peripheral surface of the pump body 1, but this may lead to an increase in production cost. Therefore, in this embodiment, a steel material containing 12% to 18% of Cr (chromium) and 3% to 7% of Ni (nickel) is adopted as a material of the pump body 1. As a result, it is possible to provide the pump body 1 with necessary durability without performing surface treatment such as plating on the outer peripheral surface of the pump body 1. More specifically, it is desirable that the material of the pump body 1 be made of a steel material containing about 16% of Cr and about 5% of Ni. By combining Cr and Ni in this way, necessary corrosion resistance can be obtained, and heat resistance can be obtained.

Here, there is a need for the high pressure pump to improve pitting corrosion resistance. Therefore, in the present embodiment, a steel material containing 0.5% to 3% Mo (molybdenum) as a material of the pump body 1 is adopted. More specifically, it is desirable to contain about 1% Mo. Mo is also a component that can increase strength and hardness at high temperature by mixing with Cr. It is also desirable to include 0.01% to 0.1% N (nitrogen). By including N, tensile strength and yield strength can be increased, and corrosion resistance such as pitting corrosion resistance and crevice corrosion resistance can be improved in particular.

In addition, since high-pressure fuel having a level of 20 MPa and a maximum of 60 MPa level acts inside the pump body 1, the pump body 1 is required to withstand a load caused by this high pressure. On the other hand, by using a steel material containing Cr, Ni, and Mo as the above-described distribution, it becomes a material which can obtain high strength characteristics with a tensile strength of 900 MPa level by heat treatment. A high strength steel material can be obtained by including N (nitrogen) of 0.01% to 0.1% and by including C (carbon) of 0.08% or less.

As a functional part of the pump body 1, a discharge joint 12*c*, a flow rate control solenoid 300, a damper cover 14, a suction joint 51, and the like are fixed by welding. When these functional parts are joined to the pump body 1 by welding, a space in which the threads engage is unnecessary as compared with screw fastening or the like. Also, for example, the discharge joint 12*c* is welded to the pump body 1 at the joint portion 12*e*, but a space can be saved such that this joint portion functions as a seal portion for shielding the fuel inside the pump from the outside of the pump. This makes it possible to miniaturize the pump, save the use of materials. When the functional parts are coupled to the pump body 1 by screw fastening, the seal portion is required separately from the fastening part, and it results in an increase in production cost.

On the other hand, when the functional parts are coupled to the pump body 1 by welding, weldability as a material of the pump body 1 is required. It is necessary that the material of the pump body 1 is made of a material having high weldability such that the altered portion caused by welding to the pump body 1 is not be cracked, or so as not to lose the resistance to impact and bending by losing its stickiness.

As described above, since the strength of the pump body 1 is required, it is conceivable to use a material such as a high strength martensitic SUS 420J 2 or SUS 431. However, after extensive studies, the inventors of the present invention have found that martensitic materials such as SUS 420J 2 and SUS 431 can obtain sufficient strength, but on the contrary, since the amount of carbon is very large, necessary weldability cannot be obtained, and weld cracking occurs. Therefore, when these materials are used for the pump body 1, and the functional parts are fixed by welding, it is impossible to provide a reliable high pressure pump by this welding crack.

Therefore, in the present embodiment, as described above, by setting Cr to 12% to 18%, Ni to 3% to 7%, and Mo to 0.5% to 3%, the pump body 1 is required to have necessary weldability. This Mo not only contributes to pitting corrosion resistance but also contributes to improve weldability. Further, by limiting the amount of carbon contained in the pump body 1 to 0.08% or less, it is possible to obtain a material sufficient for weldability. In addition, although N (nitrogen) contributes to pitting corrosion resistance, when it is too large, weldability deteriorates, and therefore it is suppressed to 0.1% or less in the present embodiment. Since P (phosphorus) and S (sulfur) are impurities, weldability is improved by using a material that suppresses P (phosphorus) and S (sulfur) contained in the pump body 1 to 0.05% or less.

The pump body 1 of the present embodiment is formed by forging. For the process of manufacturing ordinary rod-shaped material only by machining, by molding the pump body 1 by forging, it is possible to improve the material yield by providing a recessed portion and a protruding portion for the required shape. In short, it is possible to perform molding with less material for machining, and as a result it is possible to reduce the manufacturing cost.

It is also possible to forge the above-described functional parts integrally with the pump body 1. For example, it is conceivable to integrally mold the pump body 1 and the flange 1*e* for attaching and fixing the high-pressure pump to the engine by forging. Compared with the case where the pump body 1 and the flange 1*e* are coupled by welding or the like, high rigidity can be obtained, and a robust structure can be obtained. At this time, forgeability is required for the material. By making the material into the above-described chemical component, particularly by suppressing the amount of carbon to 0.08% or less, it is possible to obtain high forgeability. For imparting high forgeability, a material that suppresses impurities such as P and S to 0.05% or less is used.

For example, when Cr and Ni are increased, the austenitic material structure is obtained as compared with the above-described material of the present embodiment. In the case of forging austenitic stainless steel, work hardening is not suitable at all for forging. Further, since austenitic stainless steel has relatively large deformation resistance and therefore is not suitable for forging. In addition, not only a large load is required in the forging process but also the life of a mold deteriorates, resulting in an increase in manufacturing cost.

When the pump body 1 and the flange 1*e* are integrally formed, it is possible to make a space 1*g* thin for forging away the tool for fastening the bolt for attaching the pump. Since the material such as Cr, Ni, Mo, etc. adopted in the present embodiment is an effective material as compared with Fe (iron), it is preferable to mold the pump body 1 with a small amount of steel material. Therefore, in the present embodiment, the above-described material is used for the pump body 1, and the pump body 1 and the flange 1*e* are integrally molded by forging. Here, as illustrated in FIGS. 1 to 4, the flange portion 1*e* is formed in two places symmetrical on the outer peripheral portion of the pump body 1. Further, the pump body 1 is formed such that an outer peripheral portion 1*i* has a substantially cylindrical shape. The upper portions (upper portions in FIGS. 1, 3, and 4) of the two flange portions 1*e* are formed by recessed portions (spaces 1*g*) recessed inward with respect to an outermost peripheral end portion 1*j* of the outer peripheral portion 1*i*. With this, the above-described thinning can be performed, and the manufacturing cost can be reduced.

In addition, by using a material excellent in forgeability, the forging may be cold forging. Further, for improving formability, forging by increasing a temperature may be performed. In addition, as long as the above-described process of providing protruding and recessed portions, it is not limited to forging, but casting with controlled thermal history or a similar molding technique may be used. In this process, a protruding and recessed portion is provided in a mold to be molded, and a desired pump body shape is formed with this protruding and recessed portion.

Figure 8:
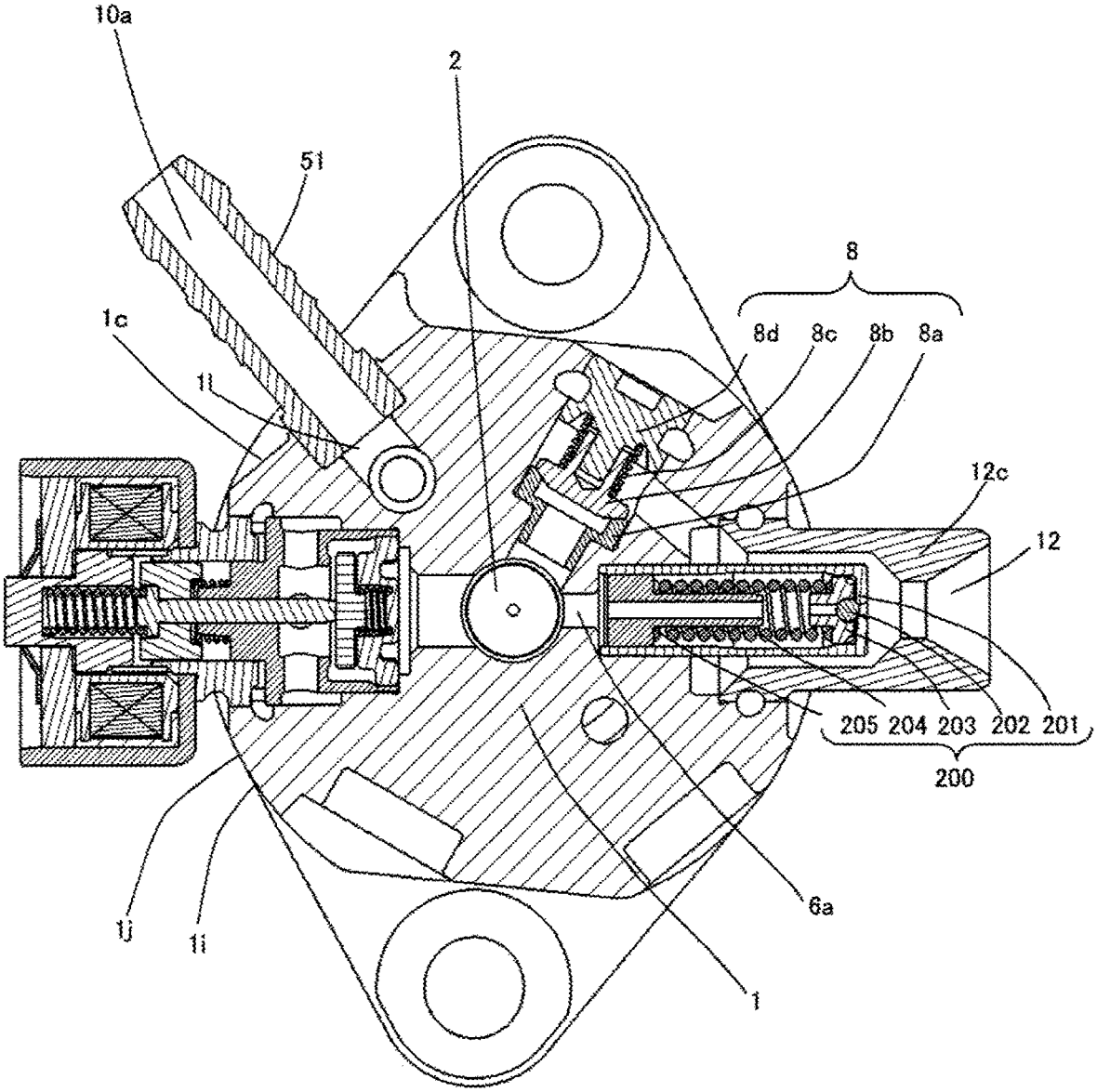
FIG. 8 is a horizontal sectional view of the high-pressure fuel supply pump, as viewed from above, in which the suction joint according to the first embodiment of the present invention is attached to a side surface of the pump body.
Figure 9:
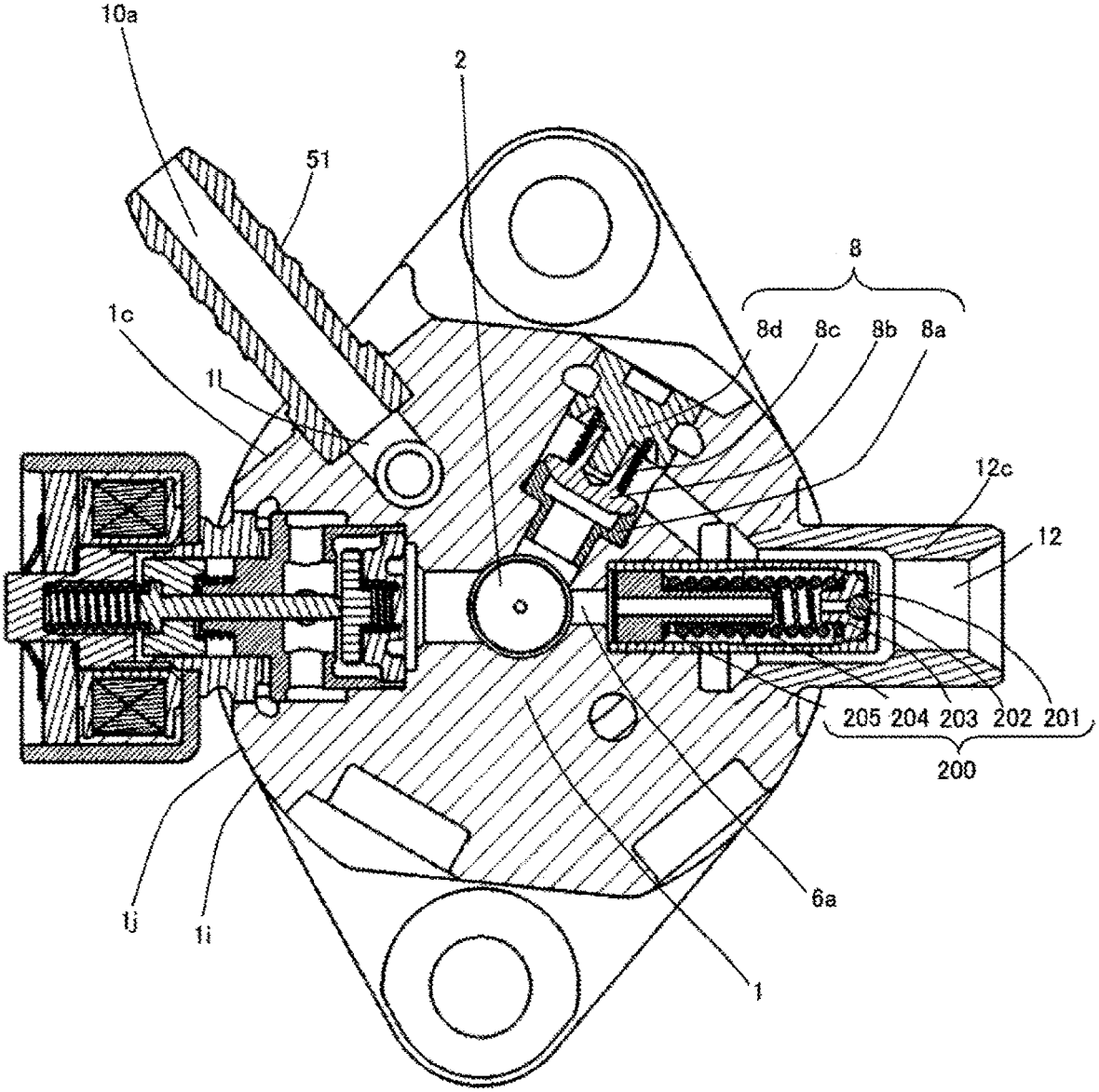
FIG. 9 is a horizontal sectional view of the high-pressure fuel supply pump, as viewed from above, in which the suction joint according to the first embodiment of the present invention is attached to the side surface of the pump body, and the discharge joint is integrated with the pump body.

By using such a material having high forgeability, it is possible not only to integrally mold the pump body 1 and the flange, but also to integrate the discharge joint 12*c* and other functional parts. FIG. 8 shows a drawing in which the discharge joint 12*c* and the pump body 1 are separate members, and the discharge joint 12*c* is fixed to the pump body 1 by welding. On the other hand, FIG. 9 is a drawing in which the material of the present embodiment is used for the pump body 1, and the discharge joint 12*c* and the pump body 1 are integrally formed by forging using the same member. By integrally molding the functional parts with the pump body 1 in this manner, it is possible to eliminate the process of the coupling process such as welding as illustrated in FIG. 8. Accordingly, it is possible to increase the production speed and to lower the manufacturing cost, and further the coupling such as welding may be damaged, but the reliability can be remarkably improved. Although not illustrated, the same effect can be obtained by integrally forming the suction joint 51 of FIGS. 8 and 9 with the same material as the pump body 1 by forging.

Further, as illustrated in FIG. 3, the pump body 1 integrally molds the engine checking and verifying portion 1*h* in which the high-pressure pump is inserted into the engine by the same member. However, as the number of parts to be integrally molded increases, the shape becomes complicated, and forging becomes difficult. For example, in accordance with the complexity and ease of forging, such as a method of prioritizing integration and thinning of the discharge joint 12*c* and the pump body 1 and making the engaging portion 1*h* with the engine separate from the pump body 1, it is also possible to flexibly select and manufacture the integrated and separate portions.

In addition, by using such a material having high forgeability, to improve the material yield, a method such as a sealing forging or blocking forging without protruding excessive material on a divided surface of a mold, not bur forging to make the excessive material protrude on the divided surface of a normal mold, and the production cost can be reduced.

After molding in the forging process, the pump body 1 is machined to a necessary portion. Specifically, for example, when the discharge joint 12*c* is fixed to the pump body 1 by welding, a coupling surface 12*e* of the welding needs to be smooth. Therefore, the pump body 1 needs machinability (ease of machining). Here, the inventors of the present invention have found that high machinability can be obtained by suppressing the amount of C (carbon) as the material of the pump body 1 to 0.08% or less and using the metal with the above-described distribution.

In addition, Mn (manganese) and S (sulfur) are contained as a material for improving the machinability as the material of the pump body 1, but when those are excessively included, forgeability and weldability deteriorate, and therefore it is desirable that Mn is suppressed to 2% or less, and S is suppressed to 0.05% or less.

As illustrated in FIG. 2, for example, when the discharge joint 12*c* is welded to the body, the pump body 1 is formed with a hole 1*k* into which the discharge joint 12*c* for discharging the fuel pressurized by the pressurizing chamber 11 is inserted. A portion of the outer peripheral portion of the pump body 1 where the hole 1*k* is formed is formed by a recessed portion 1*b* recessed inward with respect to the outermost peripheral end portion 1*j* of the outer peripheral portion 1*i*. The welded surface between the discharge joint 12*c* and the pump body 1, that is, the recessed portion 1*b* irradiated with a laser is formed on the outer peripheral side of the hole 1*k* as a flat portion in a direction perpendicular to the insertion direction of the discharge joint 12*c*. In addition, the recessed portion 1*b* is formed in a plane substantially parallel to the outer peripheral portion 1*i*. By molding the recessed portion 1*b* by forging, it is possible to reduce the material of the pump body 1, such that it is possible to reduce the cost and the weight. Since the recessed portion 1*b* is a portion to weld the discharge joint 12*c*, it is desirable to make it a smooth surface by machining, but by forming the recessed portion 1*b* by a forging process before machining, the manufacturing cost can be reduced by reducing or omitting the machining process is reduced. Further, it is possible to reduce the manufacturing cost by machining the recessed portion 1*b* only to a necessary portion of the welded portion and by leaving the forging surface in the other portion.

Therefore, in this embodiment, the pump body 1 has a machined surface, which is smoother than a forging surface, formed on the entire outer periphery at a position corresponding to the hole 1*k* in the vertical direction and has the forging surface on the lower side of the hole 1*k*. In other words, by limiting the machined surface to the minimum required and leaving the other portion as the forging surface, the production speed can be improved, and the manufacturing cost can be reduced. Although it has been described here that the forging surface is provided below the hole 1*k*, it is preferable that the forging surface is provided also to the position where the hole 1*k* is not formed at the position corresponding to the hole 1*k* in the vertical direction (height direction). Furthermore, in the case where the hole 1*k* is formed in the center in the vertical direction (height direction), if the forging surface is provided above the hole 1*k*, the manufacturing cost can be reduced as described above. In other words, it is desirable to have a forging surface around the hole 1*k* other than the portion where the hole 1*k* is formed.

As illustrated in FIGS. 8 and 9, the pump body 1 is formed with a hole portion 1*l* into which the suction joint 51 for sucking fuel is inserted. A portion of the outer peripheral portion 1*i* of the pump body 1 where the hole portion 1*l* is formed is formed with the recessed portion 1*c* recessed inward with respect to the outermost peripheral end portion 1*j* of the outer peripheral portion 1*i*. The recessed portion 1*c* is formed on the outer peripheral side of the hole 1*l* as a flat portion in a direction orthogonal to the insertion direction of the suction joint 51.

As illustrated in FIGS. 2 and 6, a hole 1*m* into which the electromagnetic suction valve 300 is inserted is formed in the pump body 1. A portion of the outer peripheral portion 1*i* of the pump body 1 where the hole portion 1*m* is formed is formed with the recessed portion 1*d* recessed inward with respect to the outermost peripheral end portion 1*j* of the outer peripheral portion 1*i*. The recessed portion 1*d* is formed on the outer peripheral side of the hole 1*m* as a flat portion in a direction orthogonal to the insertion direction of the electromagnetic suction valve 300.

As illustrated in FIG. 2, the pump body 1 is formed with a hole portion into which a stopper 8*d* for determining the stroke (movement distance) of the discharge valve 8*b* of the discharge valve mechanism 8 is inserted. A portion of the outer peripheral portion 1*i* of the pump body 1 where the hole portion is formed is formed with the recessed portion 1*n* recessed inward with respect to the outermost peripheral end portion 1*j* of the outer peripheral portion 1*i*. The recessed portion 1*n* is formed as a flat portion in a direction perpendicular to the insertion direction of the stopper 8*d* of the discharge valve mechanism 8 on the outer peripheral side of the hole portion.

By forming these recessed portions 1*c*, 1*d*, and 1*n*, the material of the pump body 1 can be reduced, such that the cost can be reduced, and the weight can be reduced. Note that the pump body 1 has a machined surface, which is smoother than a forging surface, on the entire outer periphery at a position corresponding to the hole portion in the vertical direction, and the forging surface is located below the hole portion as described above, and these are same as the above.

A flat portion (recessed portions 1*b*, 1*c*, 1*d*, and 1*n*) substantially flush with the opening surfaces of the holes (1*k*, 1*l*, and 1*m*) in a portion of the outer peripheral portion 1*i* of the pump body 1 are formed around the above-described holes (1*k*, 1*l*, and 1*m*). Further, the flat portions (recessed portions 1*b*, 1*c*, 1*d*, and 1*n*) are formed by machined surfaces formed to be smoother than the forging surface. It is desirable that the inclined surface be formed in the pump body 1 so as to spread outwardly from the flat surface portions (recessed portions 1*b*, 1*c*, 1*d*, and 1*n*) toward the lower side. It is desirable that as described above, the forging surface be formed on the pump body 1 below the flat surface portions (the recessed portions 1*b*, 1*c*, 1*d*, and 1*n*), and the inclined surface is formed so as to be connected to the forging surface.

In the material of the pump body 1 configured as described above, since the thermal expansion difference can be the same with the parts requiring hardness among the internal parts fixed by press fitting or the like to the pump body 1, for example, the cylinder 6 and the discharge valve seat 8*a*, there is an advantage that it does not have the problem that the gap is formed, and the fixing is loosened between the pump body 1 and the parts requiring the hardness at high temperature or low temperature.

Since the pump body 1 of the present embodiment can improve corrosion resistance, there is no need to provide a plating to improve corrosion resistance. A so-called platingless pump body 1 can be applied. In the present embodiment, the damper cover 14 covering the pump body 1 from above is fixed directly to the pump body 1 by welding portions. In this case, assuming that the plunged pump body is used, the welded portion of the damper cover 14 becomes a lattice pattern which loses plating, and corrosion resistance may be inferior. For this reason, it is necessary to apply a process such as applying the coating material to the welded portion after the welding and bonding, but such a process is also unnecessary in this embodiment, and the productivity can be greatly improved.

The above-mentioned plating and coating of the coating material are very difficult to control in production, in the case where there is a defect in plating or coating of the coating material, corrosion proceeds to the inside, fuel leakage from this part, and there is a possibility that the parts will be damaged. However, according to the present embodiment, such a problem can be solved.

Further, when austenitic stainless steel is used for the pump body 1, although it is rich in corrosion resistance, the parts requiring hardness among the internal parts of the high pressure pump, for example, the difference in thermal expansion between a cylinder and various valve seat parts is different. Therefore, for use at high temperature or low temperature, a gap may be formed between the pump body 1 and the part requiring hardness, there arises a problem that parts requiring hardness is loosen from the body, and it may result in performance deterioration and fuel leakage. On the other hand, according to the present embodiment, it is possible to solve such a problem.

As the material of the components of the present embodiment described above, there are the EN standards EN 1.4418 and EN 1.4313. By using such a material for the pump body 1, it is possible to provide an economical and highly reliable high pressure fuel pump having corrosion resistance, strength, weldability, forgeability, and machinability.

REFERENCE SIGNS LIST

1 pump body
2 plunger
6 cylinder
7 seal holder
8 discharge valve mechanism
9 pressure pulsation reduction mechanism
10*a* low pressure fuel suction port
11 pressurizing chamber
12 fuel discharge port
12*c* discharge joint
13 plunger seal
30 suction valve
36 anchor
40 rod biasing spring
43 electromagnetic coil
100 pressure pulsation propagation preventing mechanism
101 valve seat
102 valve
103 spring
104 spring stopper
200 relief valve
300 electromagnetic suction valve
400 welded part space
500 laser beam

The invention claimed is:

1. A high-pressure fuel supply pump, comprising:

a metal pump body forming a pressurizing chamber, wherein the pump body is made of a steel material containing 12% to 18% of Cr and 3% to 7% of Ni, and the pump body has a forging surface on a part of its outer peripheral surface, wherein the pump body is made of a steel material containing 0.5% to 3% of Mo, and the pump body has a tensile strength characteristic of at least 900 MPa.

2. The high-pressure fuel supply pump according to claim 1, wherein the pump body is made of a steel material containing 2% or less of Mn.

3. The high-pressure fuel supply pump according to claim 1, wherein the pump body is made of a steel material containing 0.08% or less of C.

4. The high-pressure fuel supply pump according to claim 1, wherein the pump body is made of a steel material containing 0.01% to 0.1% of N.

5. The high-pressure fuel supply pump according to claim 1, wherein the pump body integrally molds flanges to be attached to an engine with the same member.

6. The high-pressure fuel supply pump according to claim 1, wherein the pump body integrally molds an engine checking and verifying portion.

7. The high-pressure fuel supply pump according to claim 1, wherein the pump body integrally molds a discharge joint with the same member.

8. The high-pressure fuel supply pump according to claim 1, wherein the pump body integrally molds a suction joint with the same member.

9. The high-pressure fuel supply pump according to claim 1, wherein the material of the pump body is EN 1.4418 or EN 1.4313.

10. The high-pressure fuel supply pump according to claim 1, comprising: a cover configured to cover the pump body from above; and a weld portion configured to directly fix the cover to the pump body.

11. The high-pressure fuel supply pump according to claim 1, wherein the pump body is formed such that its outer peripheral portion has a cylindrical shape, and an upper portion of the flange portion is formed by a recessed portion recessed inward with respect to an outermost peripheral end portion of the outer peripheral portion.

12. The high-pressure fuel supply pump according to claim 1, wherein the flange portion is formed at two places symmetrical with each other on the outer peripheral portion of the pump body, the pump body is formed such that its outer peripheral portion has a cylindrical shape, and the upper portions of the two flange portions are formed by recessed portions recessed inward with respect to the outermost peripheral end portion of the outer peripheral portion.

13. The high-pressure fuel supply pump according to claim 1, wherein the pump body is formed such that its outer peripheral portion has a cylindrical shape and formed with a hole portion into which a discharge joint for discharging fuel pressurized in the pressurizing chamber is inserted, and a portion of the outer peripheral portion of the pump body where the hole portion is formed is formed by a recessed portion recessed inward with respect to the outermost peripheral end portion of the outer peripheral portion.

14. The high-pressure fuel supply pump according to claim 1, wherein the pump body is formed such that its outer peripheral portion has a cylindrical shape, a hole portion into which a suction joint for sucking fuel is inserted is formed in the pump body, and a portion in the outer peripheral portion of the pump body where the hole portion is formed is formed by a recessed portion recessed inward with respect to the outermost peripheral end portion of the outer peripheral portion.

15. The high-pressure fuel supply pump according to claim 1, wherein a hole portion into which a discharge joint for discharging fuel pressurized in the pressurizing chamber is inserted is formed in an upper portion of the pump body, the pump body has a machined surface formed to be smoother than the forging surface at a position corresponding to the hole portion, and the forging surface is located below the hole portion.

16. The high-pressure fuel supply pump according to claim 1, wherein a hole portion into which a discharge joint for discharging fuel pressurized in the pressurizing chamber is inserted is formed above the pump body, the pump body has a machined surface formed to be smoother than the forging surface at the entire outer peripheral surface at a position corresponding to the hole portion, and the forging surface is located below the hole portion.

17. The high-pressure fuel supply pump according to claim 1, wherein the pump body is formed with a hole portion into which a discharge joint for discharging fuel pressurized in the pressurizing chamber is inserted, a flat portion having the same surface as an opening surface of the hole portion is formed around the hole portion in the outer peripheral portion of the pump body, the flat portion is a machined surface formed to be smoother than the forging surface, and an inclined surface is formed on the pump body so as to extend outwardly from the flat portion toward the lower side.

18. The high-pressure fuel supply pump according to claim 1, wherein the pump body is formed with a hole portion into which a discharge joint for discharging fuel pressurized in the pressurizing chamber is inserted, a flat portion having the same surface as an opening surface of the hole portion is formed around the hole portion in the outer peripheral portion of the pump body, the flat portion is a machined surface formed to be smoother than the forging surface, and an inclined surface is formed on the pump body extending outwardly from the flat portion toward the lower side and connecting to the forging surface disposed below the flat portion.

* * * * *